United States Patent [19]

Kwasnik et al.

[11] 4,314,889

[45] Feb. 9, 1982

[54] APPARATUS TO EXTRACT CHARGING GASES FROM A COKE OVEN CHAMBER

[75] Inventors: Hans-Jurgen Kwasnik, Herne; Hans-Gunter Piduch, Bochum, both of Fed. Rep. of Germany

[73] Assignee: Dr. C. Otto & Comp. G.m.b.H., Bochum, Fed. Rep. of Germany

[21] Appl. No.: 143,245

[22] Filed: Apr. 24, 1980

[30] Foreign Application Priority Data

May 19, 1979 [DE] Fed. Rep. of Germany ..... 2920406

[51] Int. Cl.[3] ..... C10B 25/24; C10B 27/04; C10B 43/04

[52] U.S. Cl. ..... 202/241; 202/250; 202/254; 202/263; 202/269

[58] Field of Search ..... 202/263, 269, 241, 254, 202/255, 256, 257, 258, 270, 250

[56] References Cited

U.S. PATENT DOCUMENTS

| | | | |
|---|---|---|---|
| 620,409 | 2/1899 | Bocking | 202/269 X |
| 1,485,914 | 3/1924 | Greene | 202/263 X |
| 1,646,325 | 10/1927 | Strassmann | 202/269 |
| 3,160,573 | 12/1964 | Nepomniashtshy | 202/241 |
| 3,981,778 | 9/1976 | Schulte et al. | 202/263 |
| 4,168,208 | 9/1979 | Altoff et al. | 202/269 X |
| 4,207,145 | 7/1980 | Hatters et al. | 202/263 X |

FOREIGN PATENT DOCUMENTS

| | | | |
|---|---|---|---|
| 1105380 | 4/1961 | Fed. Rep. of Germany | 202/263 |
| 1381788 | 1/1975 | United Kingdom | 202/263 |

*Primary Examiner*—Frank W. Lutter
*Assistant Examiner*—Roger F. Phillips
*Attorney, Agent, or Firm*—Thomas H. Murray; Clifford A. Poff

[57] ABSTRACT

A gas-transfer tube assembly is used to extract charging gases through an orifice in the roof of one coke oven chamber and discharge the gases into an adjacent second coke oven chamber through an orifice in the roof thereof. Each orifice has a riser with an annular water seal normally closed by a removable cover. The gas-transfer tube assembly includes downwardly-extending tubular end portions with elbow parts that are selectively connected together by a straight mid-section used to change the spacing between the downwardly-extending end portions. The gas-transfer tube assembly is supported for vertical movement on a car that runs along a monorail supported by buckstays. The car is stabilized by rollers at the top of the car to engage a rail.

7 Claims, 4 Drawing Figures

II
IV
III
10
11
12
13
16
17
21
22
23
24
25
26
27
32
33
36
39
42
45

APPARATUS TO EXTRACT CHARGING GASES FROM A COKE OVEN CHAMBER

BACKGROUND OF THE INVENTION

This invention relates to apparatus to extract charging gases through an orifice in the roof of one coke oven chamber and discharge the gases into an adjacent second coke oven chamber through an orifice in the roof thereof. More particularly, the present invention relates to such an apparatus including a tubular member with downwardly-extending end portions, each connecting an orifice in the roof of adjacent oven chambers. While coking proceeds in one oven chamber, the suction applied by the gas-collecting main is adjusted to draw the charging gases through the tubular member from the other coking chamber during charging. A large portion of the charging gases evolved during charging of an oven chamber can be extracted.

Conventionally, in a battery of coke ovens, charging holes in the oven roof for the coke oven chambers are closed by conventional charging covers. However, the use of such covers does not insure smokeless operation of the coke oven battery. It is a practice to withdraw the gases evolving during the charging of coal into an oven chamber through a tube which is introduced from a charging car. The tube used to extract the charging gases becomes rapidly soiled.

SUMMARY OF THE INVENTION

It is an object of the present invention to provide an apparatus for extracting gases which evolve during charging of an oven chamber for delivery into an adjacent oven chamber in a manner to meet present-day environmental requirements.

According to the present invention, the short, straight risers communicate with holes in the oven roof at the ends of the coking chambers remote to the gas-collecting main. Each riser has a top water seal into which a seal lip of a cover engages to provide continuous reliable sealing for the orifice in the roof of each oven chamber. A tube member is disposed for vertical movement on a car or truck which is adapted to move along the coke oven battery such that annular downwardly-extending ends of the tube each communicates with an orifice in the oven roof. An annular seal lip extends from the tube ends into the water seals associated with the orifice openings.

More specifically, according to the present invention, there is provided apparatus for a battery of coke ovens to extract charging gases through an orifice in the roof of one coke oven chamber and discharge the gases into an adjacent second coke oven chamber through an orifice in the roof thereof, the apparatus includes the combination of a removable cover means including an annular water seal to normally close the orifice in the roof for each of the first and second coke oven chambers, a gas-transfer tube means including downwardly-extending tubular end portions to communicate with the orifices in the roof of the first and second oven chambers after removal of the cover means therefrom, a car including means for vertically moving the gas-transfer tube means, means to support the car for movement along the battery of coke ovens, and an annular member carried by the gas-transfer tube means for extending into the water seal of the orifice in the roof for each of the first and second coke oven chambers.

The car is preferably supported by a rail mounted on the top of buckstays used to support the masonry for the oven chambers at one side thereof. The car may additionally include means for cleaning the tube means. The tube means can be secured in a readily-releasable manner to a lifting mechanism supported by the car to facilitate removal and repositioning of the tube means.

Preferably, the tube means includes a central midportion from which elbows form downwardly-extending portions on both sides thereof. In the absence of the central midportion, the elbow members are moved into an adjoining relation and can be connected to orifices in the roof of adjacent coking chambers. When the central mid-portion is inserted between the elbow members, thereby increasing the spacing between the downwardly-extending portions thereof, the tube means is used to connect an oven chamber during charging thereof with an oven chamber remote thereto, e.g., the next but one oven chamber.

The car is preferably supported on a monorail track and a pair of rollers supported for rotation about vertical axes on the top part of the car engages on both sides of a rail for horizontal guiding during movement along the battery of coke ovens. The car preferably supports a charging hole cleaning tool which can be lowered into a charging hole after pivoting from a position in which it is disposed to form an extension of the car into a position in which it can be lowered into a charging hole.

These features and advantages of the present invention as well as others will be more fully understood when the following description is read in light of the accompanying drawings illustrating the preferred embodiment of the present invention, wherein.

Figure 1:
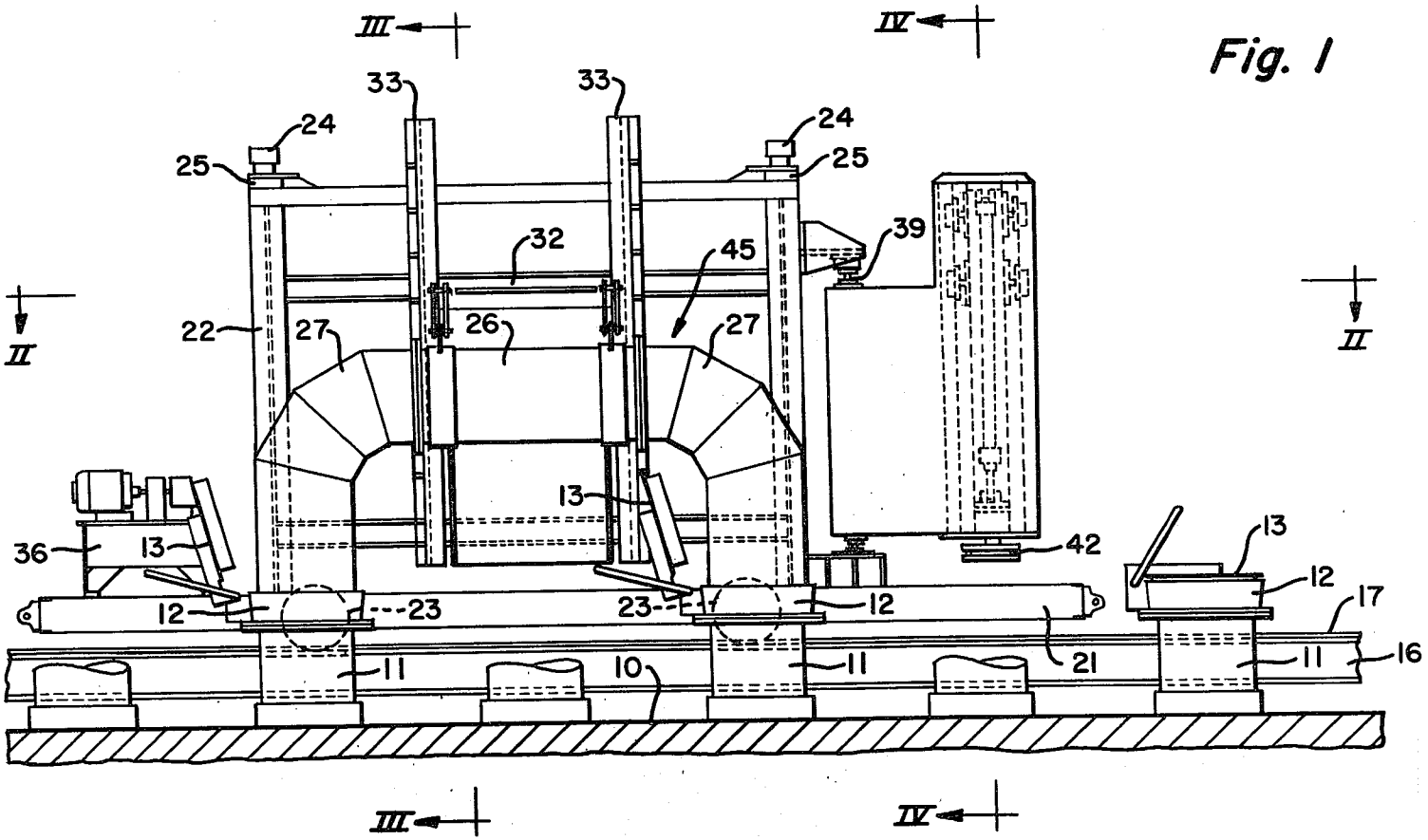
FIG. 1 is an elevational view of the apparatus to extract charging gases for a battery of coke ovens.
Figure 2:
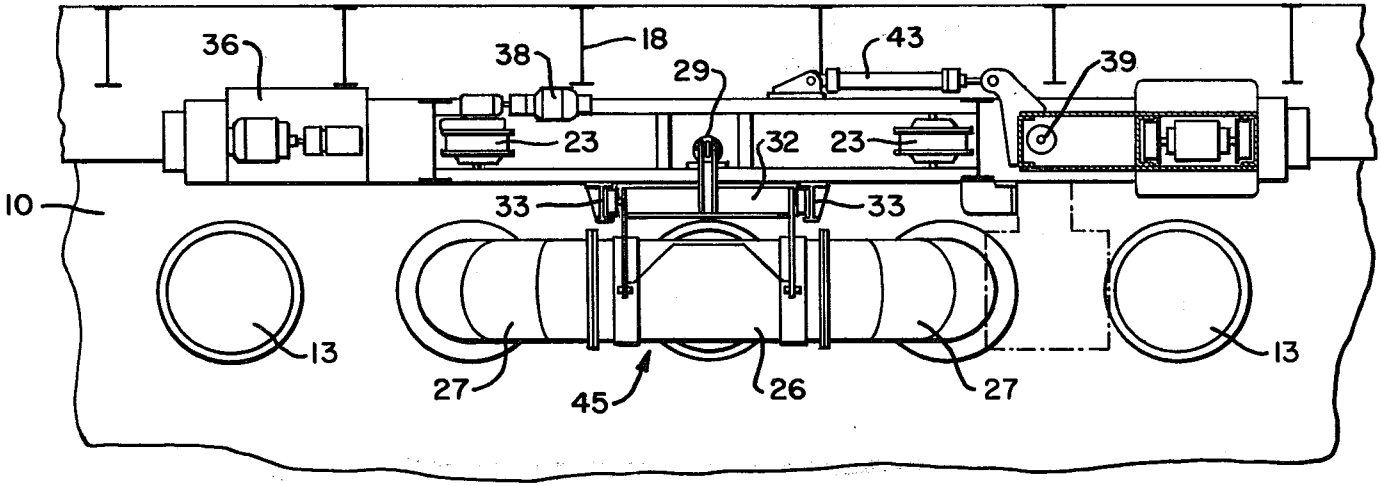
FIG. 2 is a plan view taken along line II—II of FIG. 1.

As shown in FIGS. 1–4, an oven roof 10 forms part of side-by-side coke oven chambers of a coking oven battery in a manner which is per se well known in the art. The oven roof 10 is formed with orifices into which risers 11 are inserted. An orifice with the riser 11 is provided for each oven chamber near the end of the oven which is opposite the gas-collecting main. The risers terminate at their tops with water seals 12. Covers 13 mounted for pivotal movement normally close the orifices. An outwardly-pivoted cover is shown in FIG. 1. Buckstays 14 support the oven masonry in a manner per se well known in the art. The ends of the buckstays are provided with brackets 15 and carry mountings 16 for a rail 17. Vertical sections 18 project above the buckstays and support horizontal sections 19 that retain a guide rail 20. A wagon or car 44 is supported at its top by pairs of rollers 24 arranged to engage opposite sides of the guide rail 20. Brackets 25 support pairs of the rollers 24 on the car. The car embodies a box-like construction which includes a frame formed by longitudinal sections 21 and transverse sections 22. Wheels 23 are rotatably supported by the car at spaced-apart locations (FIG. 1) for movement along the rail 17.

Figure 3:
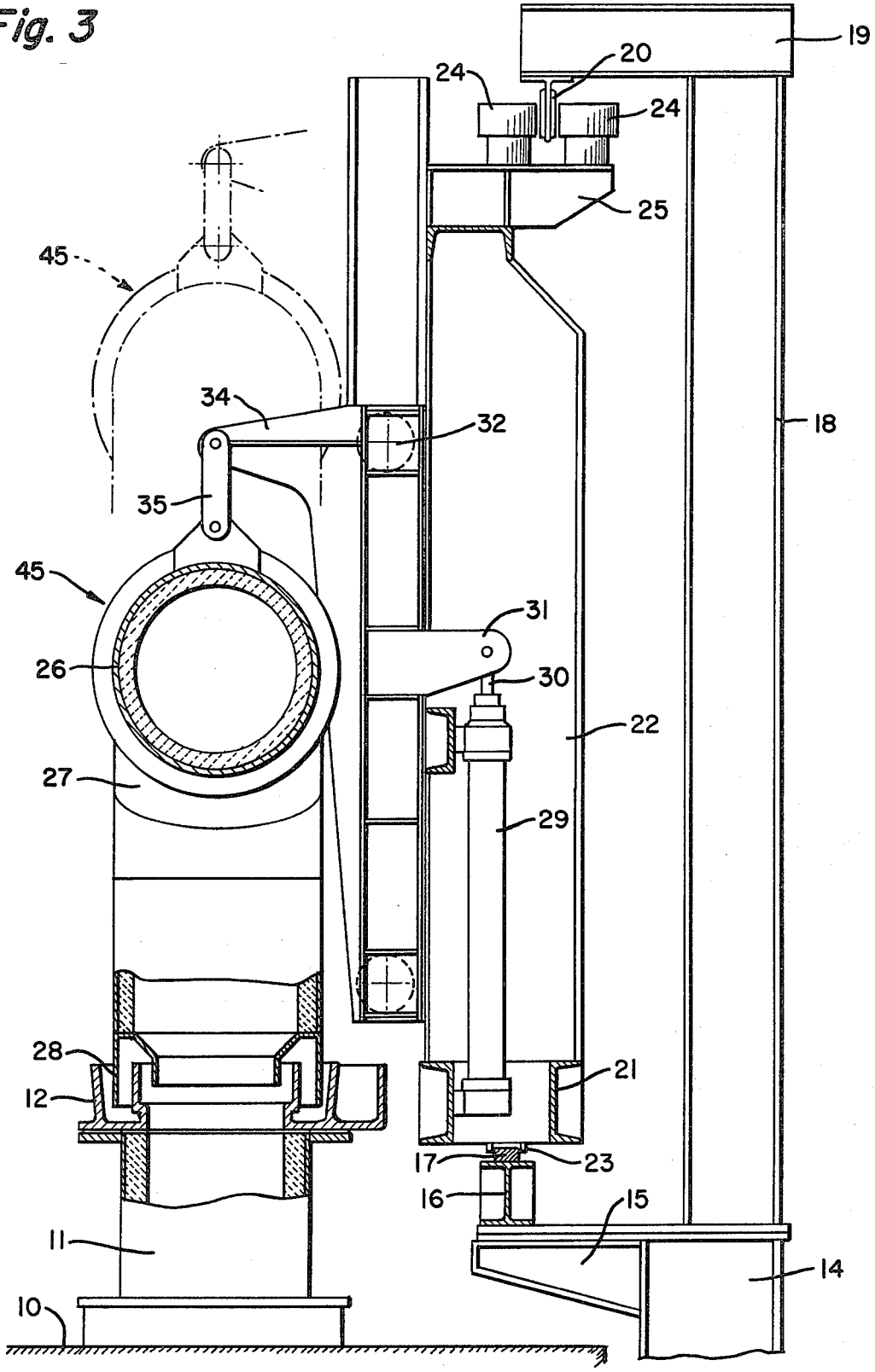
FIG. 3 is a sectional view taken along line III—III of FIG. 1.

A gas-transfer tube assembly 45 is shown in FIG. 1 and includes a central tube portion 26 and two elbow members 27 forming downwardly-extending portions, each having an annular member 28 at bottom edges thereof for extending into the water seal 12. The arrangement of the annular member for extending into the water seal 12 is best shown in FIG. 3. A piston and cylinder assembly 29 is mounted onto the car so that the rod end 30 can move in a vertical direction. The rod end 30 is coupled to an arm 31 extending from a lifting frame 32 that is guided at its opposite ends by rails 33. The lifting frame 32 supports the gas-transfer tube assembly by means of horizontal arms 34 and hangers 35. An electric motor 36 is suitably mounted on the car for driving an oil pump 37 to supply pressurized fluid to the piston and cylinder assembly 29 as well as other piston and cylinder assemblies described hereinafter. A motor 38 is coupled to rotate one of the wheels 23 for propelling the car along the battery of coke ovens.

Figure 4:
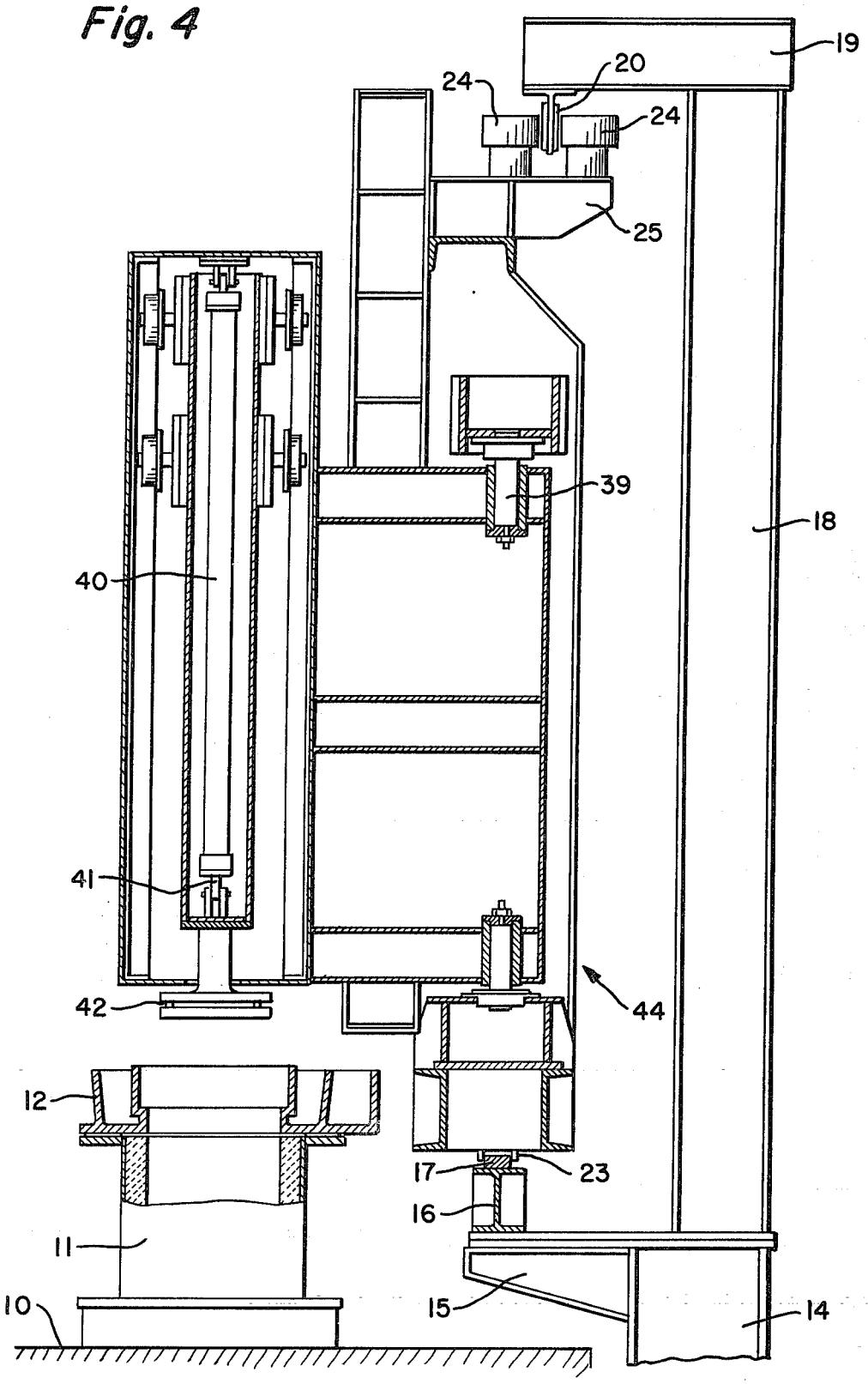
FIG. 4 is a sectional view taken along line IV—IV of FIG. 1.

Apparatus for cleaning the orifices in the roof of the oven chambers is mounted at one end of the car for pivotal movement by means of a vertical pivot shaft 39. The cleaning apparatus includes a hydraulic piston and cylinder assembly 40 having its rod end 41 coupled for carrying a cleaning tool 42. A piston and cylinder assembly 43 is supported by a clevis mounting on the car 44. The rod end of the piston and cylinder assembly 43 is coupled by a bracket to the pivot shaft 39 whereby the cleaning apparatus is pivoted from the position shown in FIG. 2 about pivot shaft 39 to the phantom-line position where it can be aligned with the opening in a riser 11. In the latter position, which is best shown in FIG. 4, operation of the piston and cylinder assembly 40 displaces the cleaning tool 42 into the orifice for cleaning thereof. It is to be understood, of course, that cover 13 must be lifted to expose the orifice for the cleaning operation.

When it is required to charge an oven chamber, the car 44 is moved into a position in which one of the elbow members 27 is disposed above the roof orifice in the oven chamber which is to be charged; while the other elbow 27 of the gas-transfer tube assembly 45 is disposed above the orifice of an adjacent oven chamber wherein the coking operation is in progress. The covers 13 for the orifices in the roof of these two oven chambers are raised and thereafter the gas-transfer tube assembly is lowered by operation of the piston and cylinder assembly 29 from the phantom-line position shown in FIG. 3 to the position shown. The annular members 28 engage in the water seals 12 to provide a smoke-tight closure. Suction applied to an operating coke oven chamber, i.e., while the coking process is underway therein, is increased to extract the charging gases through the gas-transfer tube assembly from a non-operating coke oven chamber during the charging of coal therein. Upon completion of the charging operation, the piston and cylinder assembly 29 is actuated to lift the gas-transfer tube assembly 45 to the phantom-line position shown in FIG. 3 whereupon the risers 11 are closed by replacing covers 13. A considerable portion of the gases evolved during the charging operation for an oven chamber can be removed in an effective manner by the use of the apparatus.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. Apparatus for a battery of coke ovens to extract charging gases through an orifice in the roof of one coke oven chamber and discharge the gases into an adjacent second oven chamber through an orifice in the roof thereof, said apparatus including the combination of means forming a cover including an annular water seal to normally close the orifice in the roof for each of said first and second coke oven chambers, a gas-transfer tube means including downwardly-extending tubular end portions to communicate with the orifices in the roof of said first and second oven chambers after removal of said cover therefrom, a car including means for vertically moving said gas-transfer tube means, means to support said car for movement along the battery of coke ovens, an annular member carried by said gas-transfer tube means for extending into the water seal associated with the orifice in the roof for each of said first and second coke oven chambers, and an orifice cleaning tool member supported by said car to pivot outwardly to an orifice and to move downwardly into the orifice for cleaning thereof.

2. The apparatus according to claim 1 wherein said battery of coke ovens includes buckstays to support masonry along one end of the coke oven chambers forming said battery of coke ovens, and wherein said means to support said car includes a track member mounted onto said buckstays for defining a rail to support said car.

3. The apparatus according to claim 2 wherein said track is mounted onto the tops of said buckstays.

4. The apparatus according to claim 1 wherein said means for vertically moving said gas-transfer tube means includes a releasable member engaging said gas-transfer tube means, and a lifting frame disposed on said car for carrying said releasable member.

5. The apparatus according to claim 1 wherein said gas-transfer tube means further includes a central mid-portion for selective use to conduct gas from one downwardly-extending tubular end portion to the other such that said central mid-portion extends the distance between the tubular end portion to correspond to the space between the next but one orifice in the roof of side-by-side oven chambers.

6. The apparatus according to claim 1 wherein the distance between said downwardly-extending tubular end portions corresponds to the space between orifices in the roof of adjacent coke oven chambers.

7. The apparatus according to claim 1 wherein said means to support said car includes a monorail track to support said car, a rail to guide said car horizontally, and rollers to engage opposite sides of said guide rail.

* * * * *